US005637824A

United States Patent [19]

Benyami

[11] Patent Number: 5,637,824

[45] Date of Patent: Jun. 10, 1997

[54] REACTIVE ARMOUR EFFECTIVE AGAINST NORMAL AND SKEW ATTACK

[75] Inventor: Moshe Benyami, Haifa, Israel

[73] Assignee: State of Israel, Ministry of Defence, The, Rafael Armament Development Authority, Tel-Aviv, Israel

[21] Appl. No.: 559,728

[22] Filed: Nov. 15, 1995

Related U.S. Application Data

[63] Continuation of Ser. No. 263,664, Jun. 22, 1994, abandoned.

[51] Int. Cl.[6] ..... F41H 11/00

[52] U.S. Cl. ..... 89/36.17; 109/36; 109/80

[58] Field of Search ..... 89/36.17; 109/36, 109/37, 80, 81, 82, 84

[56] References Cited

U.S. PATENT DOCUMENTS

| | | | |
|---|---|---|---|
| 469,971 | 3/1892 | Martin | 89/36.17 |
| 708,041 | 9/1902 | Hibbard | 109/82 |
| 888,052 | 5/1908 | Vaughan et al. | 89/36.17 |
| 4,368,660 | 1/1983 | Held | 89/36.17 |
| 4,741,244 | 5/1988 | Ratner et al. | 89/36.17 |
| 4,869,152 | 9/1989 | Marlow et al. | 89/36.17 |
| 5,070,764 | 12/1991 | Sheyach et al. | 89/36.17 |

FOREIGN PATENT DOCUMENTS

| | | | |
|---|---|---|---|
| 0161390 | 6/1988 | European Pat. Off. . | |
| 1581125 | 10/1980 | France . | |
| 2632059 | 12/1989 | France | 89/36.17 |

*Primary Examiner*—J. Woodrow Eldred

*Attorney, Agent, or Firm*—Nikaido Marmelstein Murray & Oram LLP

[57] ABSTRACT

An add-on reactive armor element effective against normal and skew attack. The element is a multilayer composite body in which each layer tightly bears against each contiguous layer, which multilayer composite body includes an outer cover, at least one explosive layer, at least one intermediary inert body and a base plate. The intermediary layer or layers may be, for example, of aluminium, glass or ceramics.

20 Claims, 5 Drawing Sheets

REACTIVE ARMOUR EFFECTIVE AGAINST NORMAL AND SKEW ATTACK

This application is a continuation of application Ser. No. 08/263,664 filed Jun. 22, 1994 now abandoned.

FIELD OF THE INVENTION

The present invention concerns elements for making a protective reactive armor to be fitted on the outside of an enclosure liable to be exposed to attack by shaped-charge warheads and kinetic energy projectiles. Examples of enclosures protectable by a reactive armor made of elements according to the invention are land vehicles such as battle tanks, armored personnel carriers, armored fighting vehicles, armored, self- propelled guns; armored static structures such as buildings, above-ground portions of bunkers, container tanks for the storage of fuel and chemicals; etc. A reactive armor element according to the invention may be a basic type armor made integral with a conventional passive armor, or alternatively be of the add-on type.

BACKGROUND OF THE INVENTION

Warheads with shaped-charge munition, also known as hollow charge munition, are known to pierce armor and thereby destroy the protected object from within. This capacity of a shaped charge results from the fact that upon detonation there forms an energy-rich jet also known as "thorn" or "spike" which advances at very high speed of several thousand meters per second and is thereby capable of piercing even relatively thick armor walls.

In U.S. Pat. No. 4,368,660 there is described an arrangement which purports to afford protection against the penetrating effect of an exploding shaped charge. According to that proposal there is provided a continuous wall structure having an explosive layer sandwiched between two wall members of an inert material, e.g. a metal, and being so arranged that the axis of an impinging projectile and of the jet formed upon detonation, includes with the surface of the wall structure an acute angle of say 45°. According to the U.S. patent, when a jet of a hollow charge warhead penetrates the upper surface of such a protective arrangement, it initiates the explosive layer and in consequence the walls thereof are thrown apart in opposite directions, both essentially normal to their surfaces. Thus one of the wall members moves in the direction of the protected substrate, while the other moves away and in consequence and due to the acute angle included between the jet and the wall member surfaces, the jet is successively intersected by different portions of the moving wall members with the consequence that the energy and mass of the jet are rapidly consumed whereby the jet is attenuated.

A similar arrangement is disclosed in GB-A-1,581,125 with the sole difference that in accordance with that disclosure the arrangement of the layer of explosive substance may optionally be covered only on one side by a layer of a non-combustible material.

An improved protective armor is disclosed by the present Applicants in their U.S. Pat. No. 4,741,244 and the corresponding EP-B1-O 161,390. This improved protective armor is of the add-on type and consists of a plurality of elements each comprising a cover member having suspended therefrom on the side that faces the substrate at least one explosive insert comprising an explosive layer sandwiched between two metal plates such that when the element is mounted on a substrate the explosive insert remains distant therefrom.

All these prior art reactive armors are based on the mass and energy consuming effects of moving plates and their functioning is conditional on the existence of an acute angle between the jet of an or, coming hollow charge threat and the armored itself, since only in such a case the jet is attenuated by being successively intersected by different portions of the thrown-apart wall members of a hit protective element. Such an acute angle does however not always materialize, typical examples being the roof of an armored land vehicle which is liable to be hit by a shaped charge projectile such as a cluster bomblet arriving normal or near-normal to the surface, i.e. at an angle of about 90° or close thereto, or bazooka plate liable to be hit by anti-armor warheads which may, i.a. arrive normal to such plates. In such an event conventional reactive armors do not perform their function and the jet generated by an oncoming shaped charge warhead is not significantly attenuated, if at all.

It has already been suggested to overcome this problem by mounting reactive armor elements on the roof or on bazooka plate armor askew with respect to the oncoming jet. However, such a solution is only of very little practical value, because the protection afforded in this way is limited to the case of shaped charge warheads arriving at a narrow range of angles at which the reactive armored is effective.

SUMMARY OF THE INVENTION

It is the object of the present invention to provide an element for a protective reactive armored that is suitable for affording protection against shaped charge warheads regardless of the angle of attack, including cases of normal or near-normal hits. It is a further object of the invention to provide an element of the kind specified that is also effective against armored piercing and kinetic energy projectiles.

In accordance with the invention there is provided an element for making a reactive armor, characterized by being a multilayer composite body in which each layer tightly bears against each contiguous layer, which multilayer composite body comprises an outer cover, at least one explosive layer, at least one intermediary inert body and a base plate.

A reactive armor element 20 according to the invention may be made integral with a basic armor element 21 (shown in FIG. 6(*a*) or alternatively be of the add-on type 22.

The invention further provides enclosures or an enclosure 23 (shown in FIG. 6(*b*)) fitted with a reactive armor 24, 25 consisting of elements of the kind specified. Enclosures included within the scope of the present invention comprise armored land vehicles such as battle tanks, armored personnel carriers, armored fighting vehicles, armored, self-propelled guns; armored marine vessels; armored static structures such as container tanks for holding fuel and chemicals, armored buildings and the like.

The protective effect of a reactive armor made of elements in accordance with the invention is based on a new concept by which the moving apart metal plates of conventional reactive armor are replaced by an inert body which functions by way of a so-called dynamic collapse. Thus, a jet generated by an oncoming shaped charge warhead initiates the explosive layer and in consequence a pressure builds up and acts on the inert intermediary body. Such pressure in combination with the action of the jet, sets into operation a chain of successive dynamic collapse cycles each consisting of a first phase at which a crater is produced in the inert intermediary body by the action of the penetrating jet, and a second phase at which the crater is re-closed in consequence of the pressure. In the course of such succession of cycles the jet progresses across the inert intermediary body with each tailing jet portion encountering a re-closed portion of the body. In this way the mass and energy of the jet are successively consumed and the jet is thus attenuated, deviated and scattered.

As distinct from known reactive armor, the reactive armor according to the invention is highly effective regardless of the angle of attack of a jet produced by an oncoming hollow charge warhead, and thus affords protection also against hollow charge warheads that arrive normal or near-normal to the a reactive armor surface. Accordingly, a reactive armor fitted onto a static or movable enclosure may be made entirely of elements according to the invention. In the alternative, it is possible to produce a reactive armor from elements according to the invention only at those locations such as the roof or a bazooka plate of a battle tank where normal or near-normal hits are expected, and from conventional reactive armor elements at other locations where any shaped charge threat is expected to arrive at an acute angle.

If desired, it is possible to incorporate in the reactive armor element according to the invention one or more further explosive layer, e.g. between the intermediary body and the base plate and/or within the inert intermediary body so that the element actually comprises two inert intermediary bodies sandwiching between them an explosive layer.

Where in such an embodiment the reactive armor is spaced from the basic armor and a jet produced by an oncoming hollow charge warhead forms an acute angle with the armor surface, the base plate together with the overlaying explosive layer produce a conventional reactive effect additional to the dynamic collapse effect according to the invention, which is an added benefit.

An external fuel or water tank of a land vehicle or marine vessel may, when full, serve as an inert intermediary body in a reactive armor according to the invention. The same also applies to container tanks. Accordingly, by a further aspect of the invention there is also provided a method of furnishing reactive protection to a portion of a structure holding an inert body, comprising applying to the outer face of such structure a covered explosive layer. In this way there is formed in situ a composite body of the kind described hereinbefore.

One of the purposes of the outer cover in a reactive armor according to the invention, is to afford physical protection for the explosive layer. Accordingly the outer cover may optionally either be a metal plate similar to the base plate, such metal plate being instrumental in directing inward the pressure buildup resulting from initiation of the explosive layer; or simply a suitable weather-resistant material, e.g. sheet metal, plastic material, fiberglass and the like. In the latter case the cover does not direct the pressure inward and consequently the explosive layer may have to be thicker.

There are no critical limitations on the material of the intermediary body which may be solid or liquid, metallic, e.g. aluminium, or non-metallic, e.g. glass or a ceramic material. As a rule, such materials will be preferred which on the one hand produce a pronounced dynamic collapse effect, while on the other hand are relatively light so that the reactive armor should not add too much weight to the vehicle.

Where it is desired to provide protection also against armor piercing, kinetic energy projectiles or artillery fragmentations, the material of the intermediary body will be selected accordingly, a typical example being ceramics.

Due to the fact that there is no need for moving plates in the course of operation, reactive armor elements according to the invention need not be spaced from the basic armor and may be mounted in close proximity thereto whereby the total armor volume is reduced. However, if desired the reactive armor according to the invention may be spaced from the basic armor.

A protective armor according to the invention has the further advantage that there hardly occur any impacts upon the basic armor of the kind that are usually experienced with conventional protective armor and which are due to the fact that upon detonation the innermost of the two metal plates which between them hold the explosive layer, is hurled onto the main, passive armor of the vehicle. Thus in accordance with the invention the phenomena of spalling, deformation, mechanical shock and vibration, which characterize conventional reactive armor, are practically eliminated.

The invention also provides a method of protecting an enclosure against shaped charge warheads and optionally also against kinetic threats, wherein such enclosure is fitted on the outside with a reactive armor comprising elements of the kind specified.

DESCRIPTION OF THE DRAWINGS

For better understanding the invention will now be described, by way of example only, with reference to the enclosed drawings in which.

DESCRIPTION OF SPECIFIC EMBODIMENTS

Figure 1:
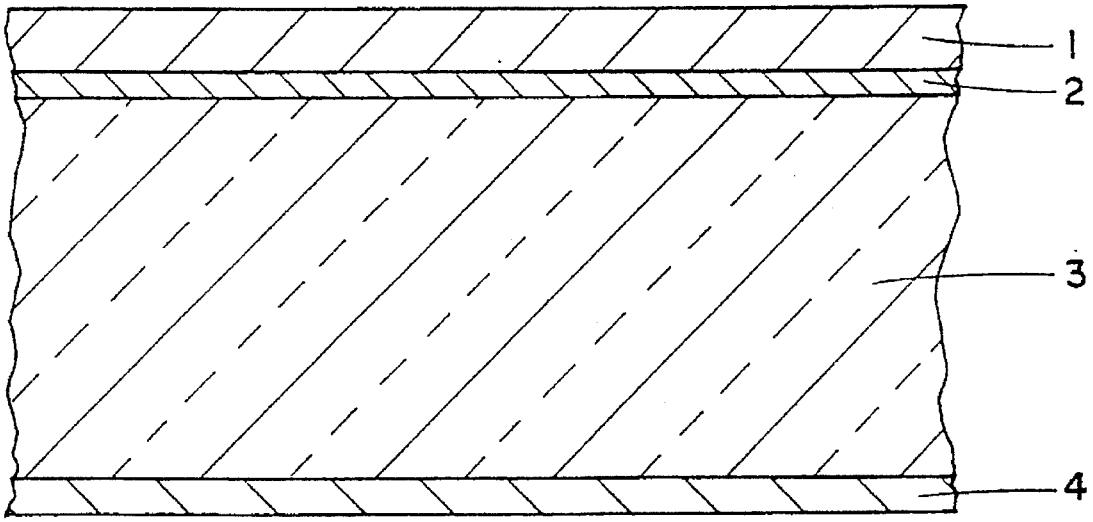
FIG. 1 is a fragmentary section across a reactive armor element according to the invention.

The protective armor element shown in FIG. 1 is a multilayer body comprising an outer cover plate 1, e.g. of steel, an explosive layer 2, an intermediary inert body 3, e.g. of aluminium, and a base plate 4 which again may be of steel.

The various phases in the operation of a reactive armor element according to the invention are shown in FIG. 2. FIG. 2*a* shows a jet 5 produced by an oncoming shaped charge warhead and approaching the armor in a direction normal thereto.

Figure 2A:
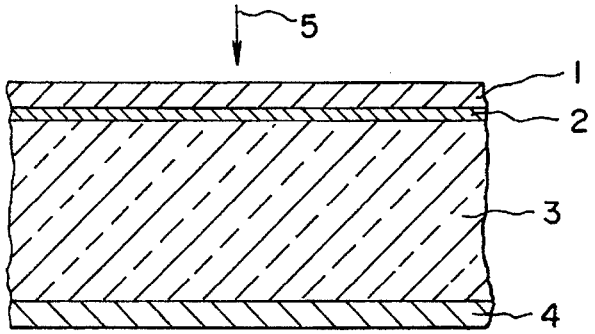
FIGS. 2*a*–2*d* show diagrammatically various operational stages of a reactive armor element according to the invention.
Figure 2B:
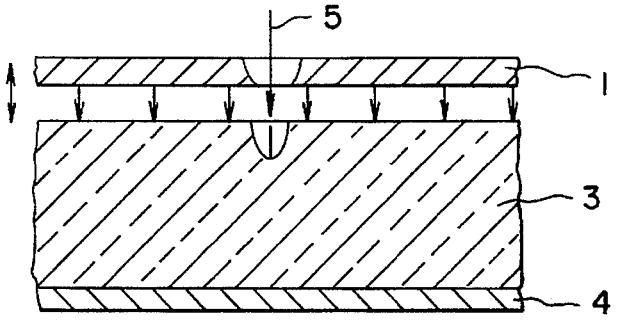

In the operational phase shown in FIG. 2*b*, jet 5 has penetrated into the explosive layer 2 by which an explosion was initiated which resulted in a pressure build-up and exertion of pressure on the intermediary inert body 3, while cover plate I is thrown in the opposite direction. In that phase a front portion of jet 5 has already penetrated into inert body 3 and formed a crater therein.

Figure 2C:
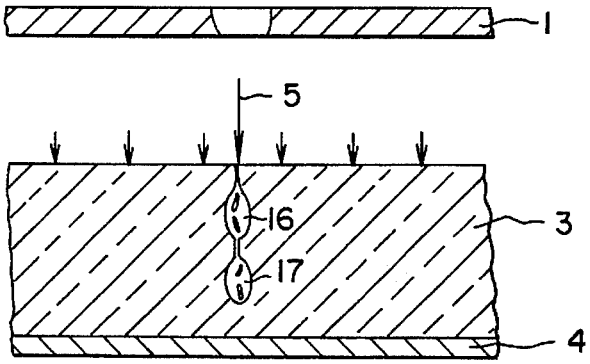

In the operational phase of FIG. 2*c*, the initial crater in body 3 has closed in consequence of the external pressure resulting from the initiation of explosive layer 2, and two different openings 16, 17 which were successively formed, are shown. This signifies the chain of successive dynamic collapse cycles which occurs in the wake of jet 5 and which consists of rapid succession of openings by the action of jet 5 and reclosures by the action of the external pressure as specified. It is further shown in FIG. 2*c* that portion of jet 5 which is already within body 3 is deviated, scattered and attenuated.

Figure 2D:
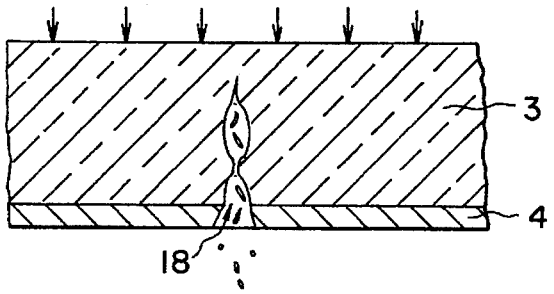

In the operational phase shown in FIG. 2*d*, the dynamic collapse effect is in its final stage while the scattered and attenuated segments 18 of the jet have perforated bottom plate 4.

Figure 3:
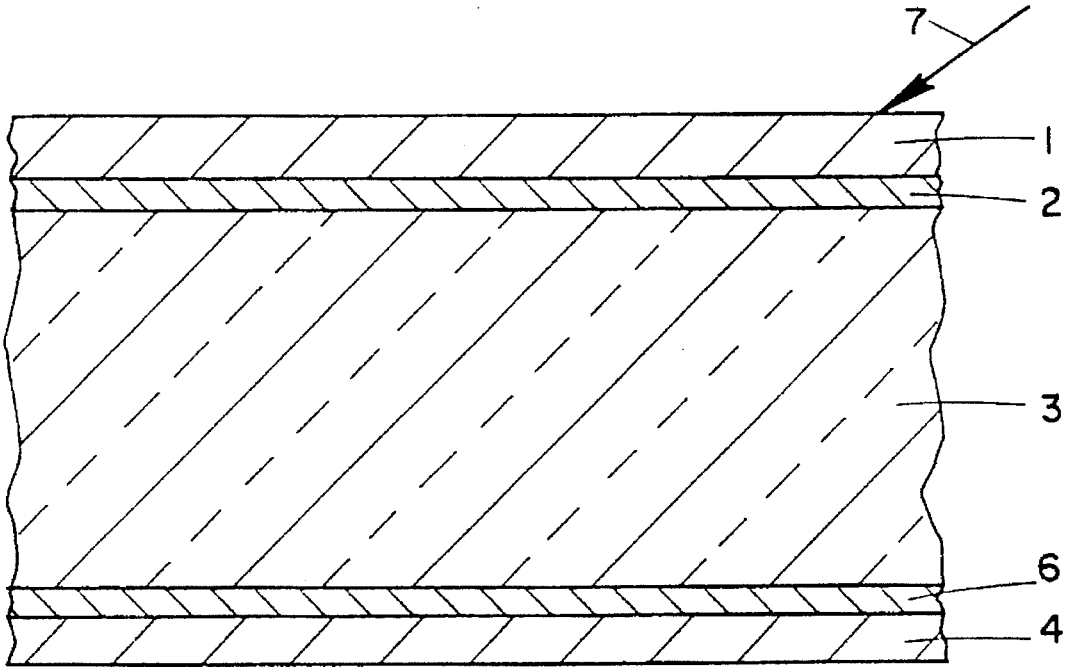
FIG. 3 is a fragmentary section across another embodiment of a reactive armor according to the invention.

The embodiment of a reactive armor element according to the invention shown in FIG. 3 is basically similar to that of FIG. 1 with the addition, however, of a second explosive layer 6 which is sandwiched between inert body 3 and base plate 4. This addition improves performance in particular in cases of threats that arrive at an acute angle, such as threat 7 in FIG. 3.

Figure 5:
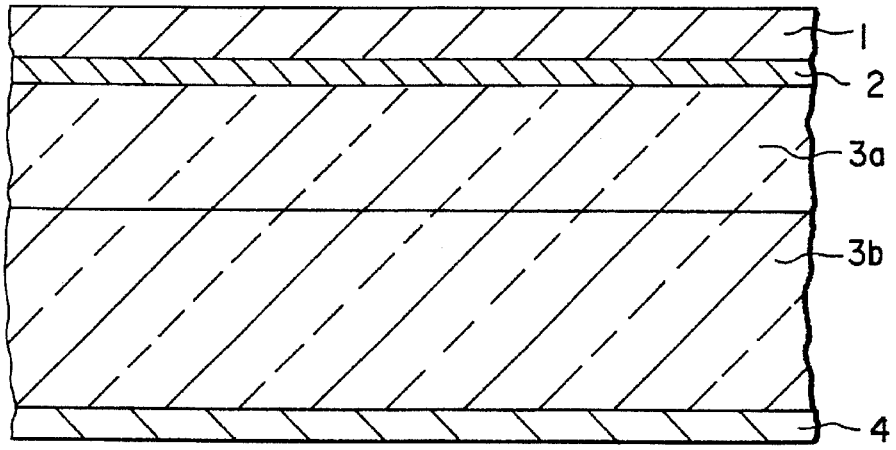
FIG. 5 is a fragmentary section across another embodiment.
Figure 6A:
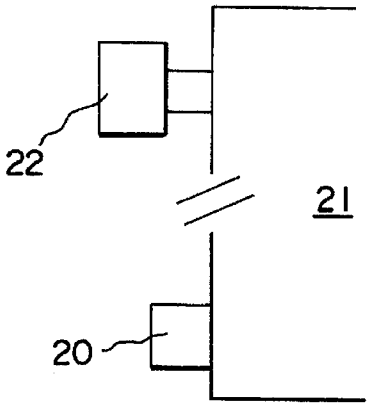
FIGS. 6(*a*) and 6(*b*) show an enclosure or element to which the reactive armor is fitted.
Figure 6B:
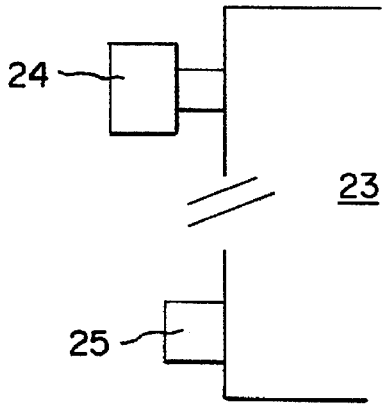

If desired the inert body 3 may consist of two (3*a*, 3*b* shown in FIG. 5) or more strata of different inert materials.

Figure 4:
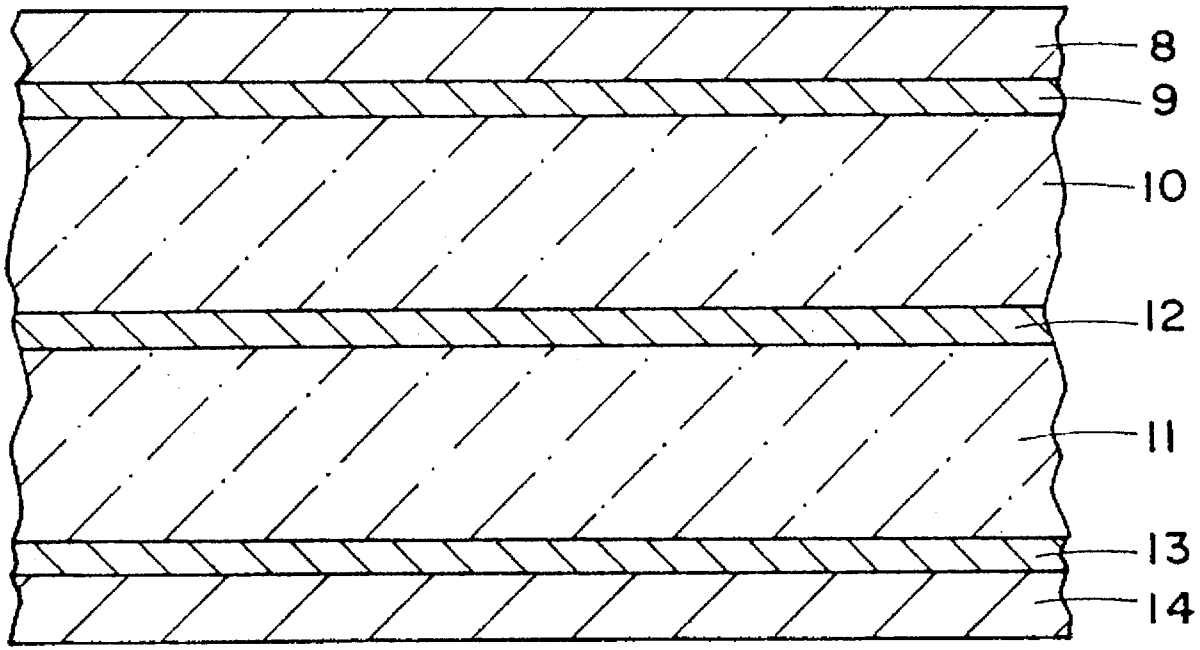
FIG. 4 is a fragmentary section across yet another embodiment of a reactive armor according to the invention.

In the embodiment of a reactive armor element of FIG. 4 yet another explosive layer is provided. As shown this embodiment comprises a cover plate 8, a first explosive layer 9, a first intermediary body 10 and a second intermediary body 11 having a second explosive layer 12 sandwiched between them. Intermediary bodies 10 and 11 may be of the same material or of different materials. Underneath body 11 there is provided a third explosive layer 13 followed by a baseplate 14.

I claim:

1. An element for making a reactive armor for protection against a shaped-charge warhead, comprising: a multi-layer composite body in which each layer tightly bears against each contiguous layer, which multi-layer composite body includes an outer metal cover plate, at least one explosive layer, at least one intermediary inert body juxtaposed to each of said at least one explosive layer and which is thicker than an aggregate thickness of the outer cover plate and any juxtaposed explosive layer, and a metal base plate, wherein on initiation of said explosive layer a succession of dynamic collapse cycles occurs in which said at least one intermediary inert body collapses into a crater formed by a penetrating jet originating from an oncoming shaped-changed warhead.

2. An element according to claim 1 being integral with a basic armor element.

3. An element according to claim 1 being of an add-on type.

4. An element according to claim 1, further comprising a second explosive layer between the intermediary inert body and base plate.

5. An element according to claim 4, further comprising a third explosive layer sandwiched between two intermediary inert bodies.

6. An element according to claim 1, wherein said at least one inert intermediary body is of a single material.

7. An element according to claim 1, wherein said at least one inert intermediary body comprises two or more strata of different materials.

8. An enclosure fitted with a reactive armor for protection against a shaped-charge warhead comprising: a plurality of elements each being a multi-layer composition body in which each layer tightly bears against each contiguous layer, which multi-layer composition body includes an outer metal cover plate, at least one explosive layer, at least one intermediate inert body juxtaposed to each of said at least one explosive layer and which is thicker than an aggregate thickness of the outer cover plate and any juxtaposed explosive layer, and a metal base plate, wherein on initiation of said explosive layer a succession of dynamic collapse cycles occurs in which said at least one intermediary inert body collapses into a crater formed by a penetrating jet originating from an oncoming shaped-charge warhead.

9. An enclosure according to claim 8 being an armored land vehicle.

10. An enclosure according to claim 9 wherein said armored land vehicle is a battle tank.

11. An enclosure according to claim 10 wherein said armored land vehicle is one of a personnel carrier and an armored fighting vehicle.

12. An enclosure according to claim 11 wherein said armored land vehicle is armored, self-propelled gun.

13. An enclosure according to claim 8 being a marine vessel.

14. An enclosure according to claim 8 being a container tank.

15. An enclosure according to claim 8 being a building.

16. A method of protecting an enclosure against a shaped-charge warhead and optionally against kinetic stress, comprising the step of:

fitting the enclosure on an outside with a reactive armor for protection against said shaped-charged warhead, said reactive armor made of a plurality of elements each being a multilayer composition body in which each layer tightly bears against each contiguous layer, which multi-layer composite body includes an outer metal cover plate, at least one explosive layer, at least one intermediary inert body juxtaposed to each of said at least one explosive layer and which is thicker than an aggregate thickness of the outer cover plate and any juxtaposed explosive layer, and a metal base plate, wherein on initiation of said explosive layer a succession of dynamic collapse cycles occurs in which said at least one intermediary inert body collapses into a crater formed by a penetrating jet origination from an oncoming shaped-charge warhead.

17. A method according to claim 16 further comprising the step of applying to an outside of an inert body contained within said enclosure a covered explosive layer.

18. A method according to claim 17 wherein the enclosure is a laud vehicle or marine vessel and wherein a covered explosive layer is applied to an outside of a liquid holding compartment.

19. A method according to claim 18, wherein said liquid holding compartment holds fuel.

20. A method according to claim 18, wherein said liquid holding compartment holds water.

* * * * *